US005913676A

United States Patent [19]

Kim

[11] Patent Number: 5,913,676

[45] Date of Patent: Jun. 22, 1999

[54] COMBINATION LIGHTER AND CIGAR CUTTER

[75] Inventor: Hyun Ki Kim, Incheon, Rep. of Korea

[73] Assignee: East-West Trading Corp., Chicago, Ill.

[21] Appl. No.: 09/073,498

[22] Filed: May 5, 1998

[51] Int. Cl.[6] ..... F23D 11/36; A24F 13/24

[52] U.S. Cl. ..... 431/253; 131/249

[58] Field of Search ..... 431/253, 129, 431/144, 271, 344; 131/249, 243, 248, 234

[56] References Cited

U.S. PATENT DOCUMENTS

| | | | |
|---|---|---|---|
| 306,672 | 10/1884 | Brown . | |
| D. 377,845 | 2/1997 | Maruyama . | |
| D. 387,474 | 12/1997 | Fontaine, Jr. . | |
| 661,667 | 11/1900 | Mc Intyre | 131/249 |
| 815,219 | 3/1906 | Rooll | 131/249 |
| 1,068,300 | 7/1913 | Baumbach . | |
| 1,502,974 | 7/1924 | Aronson . | |
| 2,499,752 | 3/1950 | Hrabal . | |
| 4,600,022 | 7/1986 | Pierce, Jr. | 131/249 |
| 4,897,033 | 1/1990 | Yang | 431/253 |
| 5,738,117 | 4/1998 | Fountain, Jr. | 431/253 |

*Primary Examiner*—James C. Yeung

*Attorney, Agent, or Firm*—Trexler, Bushnell, Giangiorgi & Blackstone, Ltd.

[57] ABSTRACT

A combination lighter and cigar cutter device comprising a lighter body adapted to create a flame and defining a slot; a cigar cutter slidably engaged with the lighter body and slidable between a housed position wherein the cigar cutter is received substantially within the slot and a cutting position wherein the cigar cutter is substantially outside of the lighter body, the cigar cutter including a cutting knife housing and a cutting knife; and a spring-biased stop associated with the cigar cutter adapted to releasably lock the cutting knife housing to the lighter body to prevent the cutting knife housing from sliding toward the housed position when the cigar cutter is in the cutting position and to unlock the cutting knife housing from the lighter body to permit the cutting knife housing to slide from the cutting position toward the housed position. Desirably, the cigar cutter is substantially concealed by the lighter body when the cigar cutter is in the housed position.

21 Claims, 3 Drawing Sheets

FIG. 1
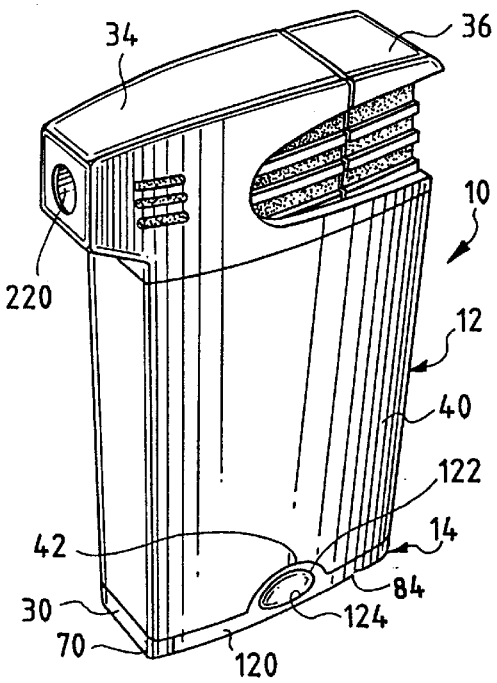
FIG. 2
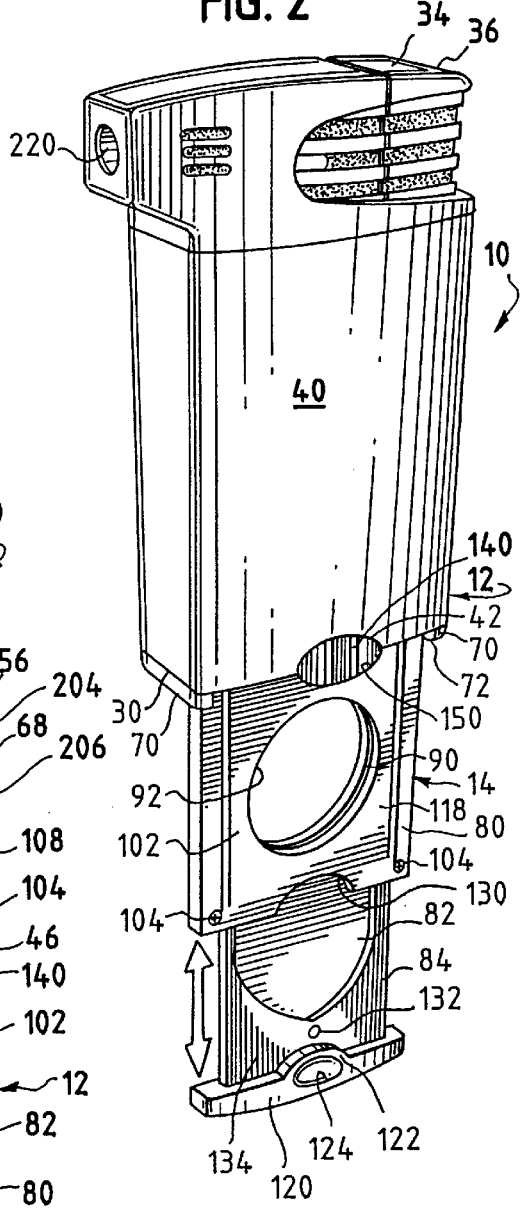
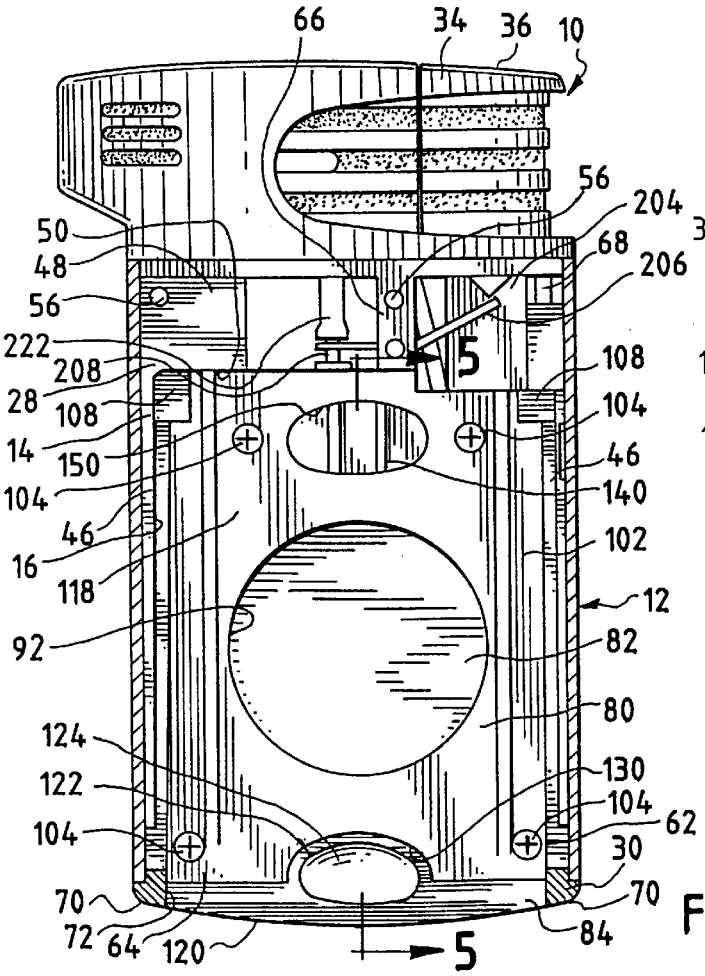
FIG. 3

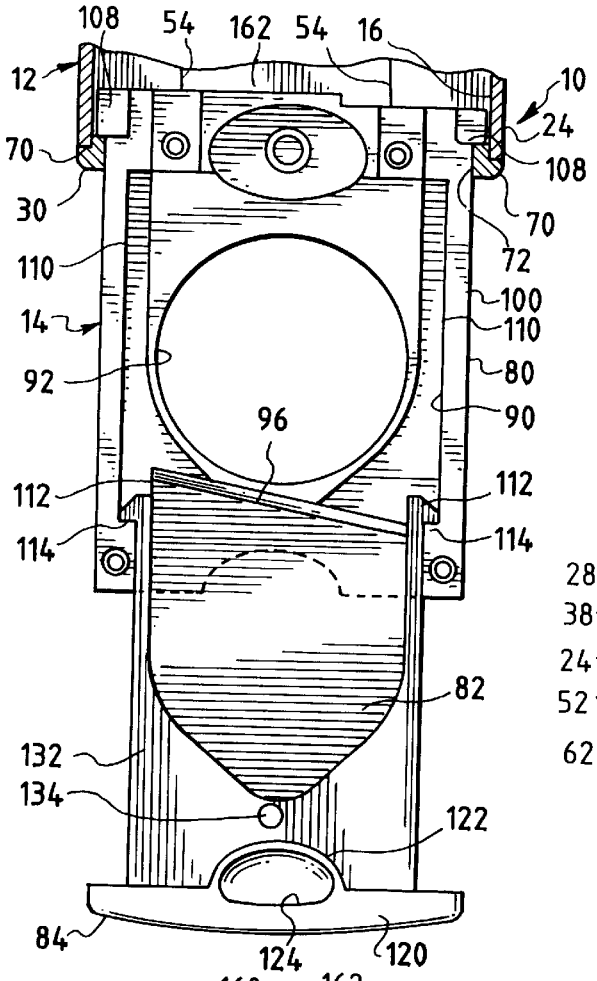
FIG. 4
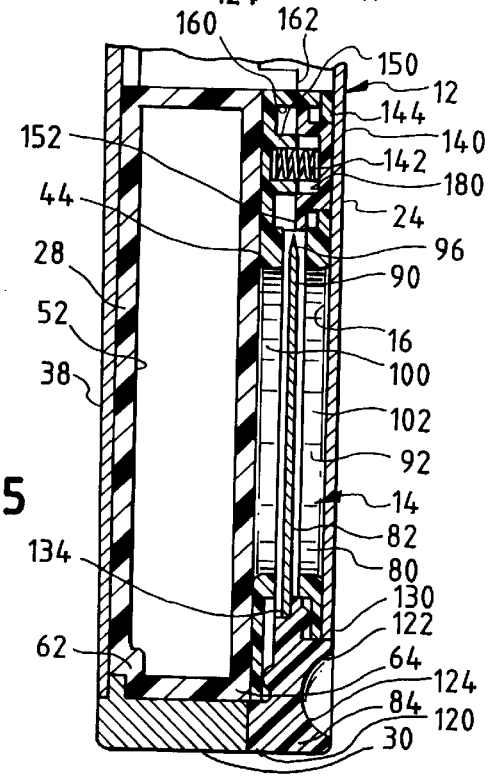
FIG. 5
FIG. 6
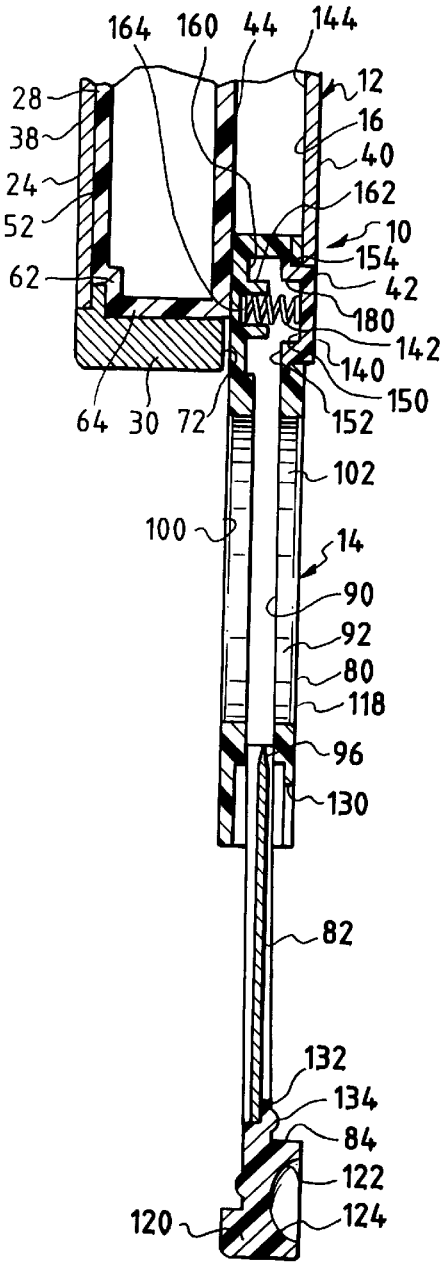

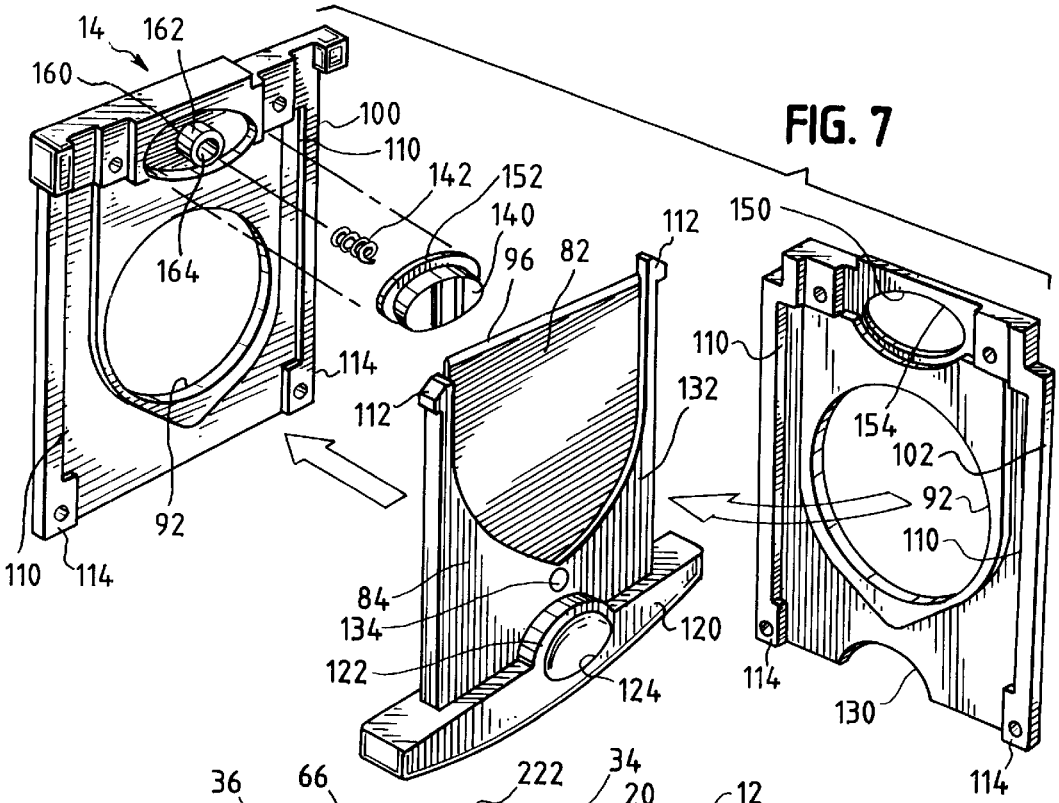
FIG. 7
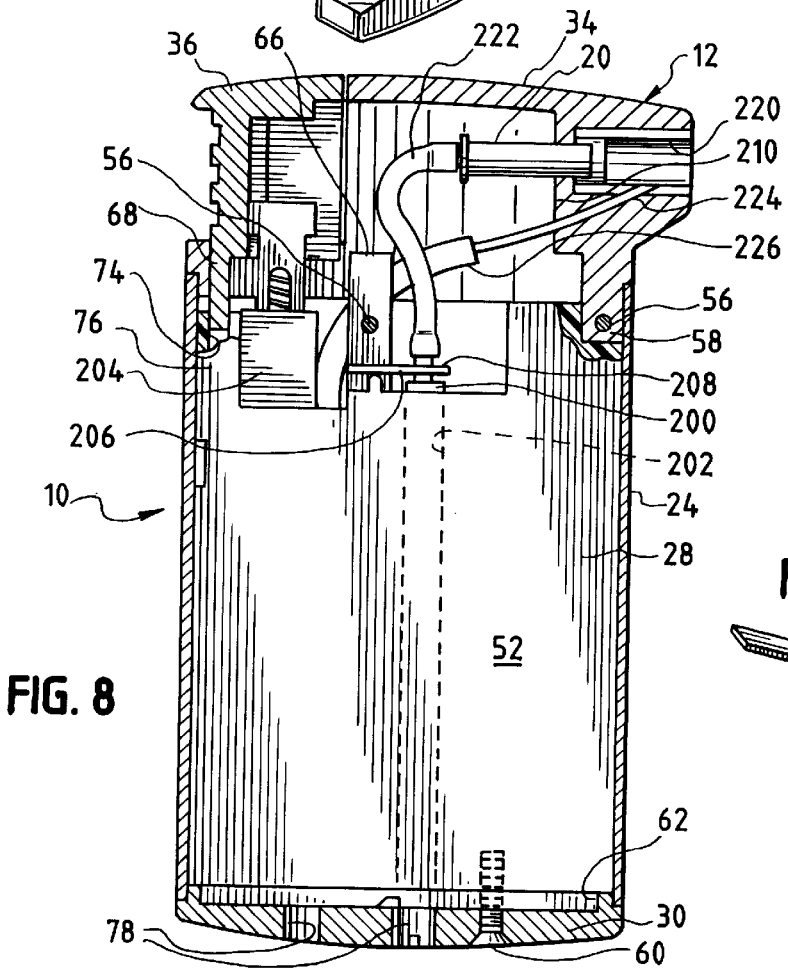
FIG. 8
FIG. 9
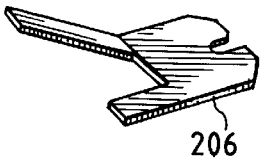

COMBINATION LIGHTER AND CIGAR CUTTER

BACKGROUND

Combining cigar cutters with lighters is known in the art. Such devices typically have awkward configurations, however, because cigar cutters include cutting edges and moving pieces and thus do not complement the shape of lighters. As a result, such devices may be awkward to handle and use. Additionally, the cigar cutters are typically exposed even when they are not being used, which may present many problems. For example, because it is exposed, a cigar cutter encounters moisture, dirt, dust or other undesirable matter which will affect the effectiveness as well as the lifespan of the cigar cutter. Additionally, because it includes at least one moving part and a cutting edge, a cigar cutter often presents safety concerns.

Therefore, it is an object of the present invention to provide a combination lighter and cigar cutter having a neat and compact appearance.

It is a further object of the present invention to provide a combination lighter and cigar cutter wherein the cigar cutter can be slid from a housed position to a cutting position and can be releasably locked in the cutting position.

It is a still further object of the present invention to provide such a device wherein the cigar cutter is substantially concealed within the body of the lighter when the cigar cutter is in the housed position.

SUMMARY

In accordance with these and other objects, the present invention provides a lighter device comprising: (a) a lighter body adapted to create a flame and defining a slot; (b) a cigar cutter slidably engaged with the lighter body and slidable between a housed position wherein the cigar cutter is received substantially within the slot and a cutting position wherein the cigar cutter is substantially outside of the lighter body, the cigar cutter including a cutting knife housing and a cutting knife; and (c) a stop associated with the cigar cutter adapted to releasably lock the cutting knife housing to the lighter body to prevent the cutting knife housing from sliding toward the housed position when the cigar cutter is in the cutting position and to unlock the cutting knife housing from the lighter body when the cigar cutter is in the cutting position to permit the cutting knife housing to slide from the cutting position toward the housed position. The cutting knife desirably is slidably received by a passage defined by the cutting knife housing and adapted to slide between an open position and a closed position.

The device desirably also includes a spring for biasing the stop to cause such releasable lock as the stop passes outside of the slot. In a preferred embodiment, the cutting knife housing defines a bore receivably engaging the stop, and the lighter body defines a notch configured for receiving the stop when the cigar cutter is in the cutting position. The device may also include a handle portion associated with the cutting knife and having a finger tab, and the notch of the lighter body receives the finger tab when the cigar cutter is in the housed position. Additionally, the cutting knife housing may define a notch configured to receive the finger tab when the cutting knife is in the closed position. Desirably, the cigar cutter is substantially concealed by the lighter body when the cigar cutter is in the housed position.

The lighter device in accordance with preferred embodiment of the present invention has a neat and compact appearance, and enables the cigar cutter to be slid from the housed, and desirably substantially concealed, position to the cutting position in an effective manner. Because the cigar cutter is substantially concealed when not in use, it is not always exposed to moisture, dirt, dust or other undesirable matter and, thus, tends to have a longer life than the cigar cutters of the prior art devices. Additionally, because the cigar cutter is substantially concealed when not in use, the cutting knife is less likely to cause injury than the cutting knives of the prior art devices.

BRIEF DESCRIPTION OF THE DRAWINGS

The present invention and the advantages thereof will become more apparent upon consideration of the following detailed description when taken in conjunction with the accompanying drawings:

FIG. 1 is a perspective view of a lighter device having a cigar cutter in accordance with a preferred embodiment of the invention, with the cigar cutter in a housed position;

FIG. 2 is a perspective view of the lighter device of FIG. 1 with the cigar cutter in a cutting position, illustrating with an arrow the direction of movement of the cutting knife of the cigar cutter between an open position and a closed position;

FIG. 3 is a front elevational view of the lighter device of FIGS. 1 and 2, with the cigar cutter in the housed position, with the shell of the lighter body illustrated in cross section to show the cigar cutter and components of the lighter mechanism;

FIG. 4 is a fragmentary view of the lighter device of FIGS. 1 and 2 with the cigar cutter in the cutting position and the cutting knife in the open position and with one of the housing members of the cutting knife housing, the stop and the spring removed to illustrate the cutting knife handle portion engaged with the other housing member of the cutting knife housing;

FIG. 5 is a cross section view taken along the line 5—5 of FIG. 3;

FIG. 6 is a fragmentary view of the lighter device of FIGS. 1 and 2 illustrating in cross section the cigar cutter in a cutting position and the cutting knife in an open position;

FIG. 7 is an exploded view of the cigar cutter of the lighter device of FIGS. 1 and 2;

FIG. 8 is a rear elevational view of the lighter device of FIGS. 1 and 2 with the cigar cutter in the housed position and with the shell of the lighter body shown in cross section to illustrate the spacer member and components of the lighter mechanism; and FIG. 9 is a perspective view of the lever arm of the lighter mechanism of the lighter device of FIGS. 1 and 2.

DETAILED DESCRIPTION OF PREFERRED EMBODIMENTS

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

FIGS. 1–9 illustrate a lighter device 10 in accordance with a preferred embodiment of the invention comprising generally a lighter body 12 and a cigar cutter 14 slidably received within a slot 16 defined by the lighter body. The cigar cutter 14 is adapted to slide between a housed position where it is substantially received by the slot 16 and concealed by the lighter body 12 (see, e.g., FIGS. 1, 3, 5 and 8) and a cutting position where it is substantially outside of the lighter body 12 and can be used for cutting a cigar or the like (see, e.g., FIGS. 2, 4 and 6). The lighter body 12 includes a lighter mechanism 20 for creating a flame for lighting the cigar or the like.

The illustrated lighter body 12 further includes a hollow shell 24, a spacer member 28 housed within the shell 24, a bottom member 30, and a head portion 34 having a switch member 36. The shell 24 includes a rear portion 38 and a front portion 40, both of which desirably are arcuate. The front portion 40 of the shell 24 defines an arcuate notch 42 to facilitate releasable engagement between the cigar cutter 14 and the lighter body 12 as hereinafter described. The spacer member 28 and the shell 24 together define the slot 16 extending most of the length of the lighter body 12 for slidably receiving the cigar cutter 14.

The spacer member 28 and the lighter body 12 desirably are configured so that the cigar cutter 14 is received snugly within the slot 16 when it is in the housed position and also so that the lighter mechanism 20 is suitably housed within the shell 24 and the head portion 34. In the illustrated, for example, the spacer member 28 includes a generally flat front surface 44 and a pair of opposed and longitudinally-extending side walls 46 extending from the front surface and further defining the slot 16. The side walls 46, which extend substantially the entire length of the spacer member 28, guide the cigar cutter 14 during sliding. The spacer member 28 also includes a generally rectangular step 48 portion adjacent the front surface 44 having a wall 50 extending to the front surface further defining the slot 16 for abutting the cigar cutter when it is in the closed position. The spacer member 28 includes a rear surface 52 that desirably is arcuate to complement the arcuate configuration of the rear portion 38 of the shell 24. The front surface 44 of the spacer member 28 may include a pair of longitudinally-extending ribs 54 to facilitate sliding of the cigar cutter 14.

The head portion 34 may be mounted to the spacer member 28 in any suitable manner such as by a plurality of metal suds 56 or the like. In the illustrated embodiment, one of the metal studs 56 extends through the spacer member 28 at the step 48 and through a downwardly extending tongue 58 of the head portion 34. The other metal stud 56 extends through a pair of downwardly extending projections 66 of the head portion 34 and through an upwardly extending projection (not shown) of the spacer member 28 and between the projections 66. The upwardly extending projection of the spacer member 28 may also include a boss (also not shown) abutting the cigar cutter 14 when it is in the housed position. Additionally, in the illustrated embodiment, the switch member 36 includes a tongue 68 slidably received by a passage 74 defined by an upward projection 76 of the spacer member 28.

The bottom member 30 may be secured to the spacer member 28 in any suitable manner such as, for example, by a screw 60 or the like, and may define a void 62 for receivingly engaging an end portion 64 of the spacer member 28. The bottom member 30 includes a pair of shoulder members 70 that define a U-shaped aperture 72 in communication with the slot 16. The distance between the shoulder members 70 of the bottom member 30 desirably is slightly less than the distance between the opposed walls 50 of the spacer member 28 so that the shoulder members can abuttingly engage the cigar cutter 14, as hereinafter described, to maintain engagement between the cigar cutter 14 and the lighter body 12 when the cigar cutter 14 is in the cutting position. The bottom member 30 may also define one or more apertures 78 for use in connection with the fueling or other operation of the lighter mechanism 20.

The cigar cutter 14 comprises a cutting knife housing 80, a cutting knife 82 slidingly engaged therewith, and a cutting knife handle portion 84 integral with, and extending rearwardly of, the cutting knife. The cutting knife housing 80 and cutting knife handle portion 84 may be constructed of any suitable material such as plastic or the like. The cutting knife 82 desirably is constructed of metal.

The cutting knife housing 80 defines an elongated passage 90 substantially along its length slidably receiving the cutting knife 82 and a circular hole 92 for receiving a cigar for cutting by the cutting knife. The cutting knife 82 is adapted to slide relative to the cutting knife housing 80 between a closed position (see, e.g., FIGS. 1, 3, 5 and 8) and an open position (see, e.g., FIGS. 2, 4 and 6). The illustrated cutting knife 82 includes a cutting edge 96 that desirably extends at a slight angle relative to the latitudinal axis of the lighter body 12 to enhance its cigar cutting ability.

In the illustrated embodiment, the cutting knife housing 80 comprises a pair of housing members 100 and 102 that are joined together in any suitable manner, such as, for example, by a plurality of fasteners 104. The housing member 100 defines a pair of opposed bosses 108 for abuttingly engaging the shoulder member 70 of the bottom member 30 when the cigar cutter 14 is in the cutting position to prevent the cigar cutter 14 from disengaging from the lighter body 12. Each of the housing members 100 and 102 includes opposed longitudinal guide walls 110 for slidably engaging opposed side lips 112 defined by the cutting knife handle portion 84 to facilitate sliding of the cutting knife 82 relative to the cutting knife housing 80, and a pair of shoulders 114 restricting further outward sliding of the cutting knife 82 when the cutting knife is in the open position to prevent the cutting knife from disengaging from the cutting knife housing 80. The housing member 102 desirably includes an outer surface 118 that is arcuate to complement an arcuate inner wall 144 of the front portion 40 of the shell 24.

The cutting knife handle portion 84 also includes a base 120 and a finger tab 122, desirably with a recessed area 124, to facilitate manual gripping of the cutting knife handle portion 84 to cause sliding of the cutting knife 82. The housing member 102 defines a notch 130 for receiving the finger tab 122 when the cigar cutter 14 is in the housed position or when the cutting knife 82 is otherwise in a closed position. The cutting knife handle portion 84 is configured to be received by the passage 90 defined by the cutting knife housing 80. The base 120 of the cutting knife handle portion 84 is configured to substantially enclose the slot 16 of the lighter body 12 when the cigar cutter 14 is in the housed position. Thus, the length of the base 120 desirably is substantially the same as or slightly less than the distance between shoulder members 70 of the bottom member 30.

Additionally, the cutting knife 82 desirably is adapted to be releasably locked to the cigar cutter 14 housing when the cutting knife 82 is in the closed position so that the cutting knife tends to remain in the closed position. In the illustrated embodiment, for example, the front face 132 of the cutting knife handle portion 84 includes a boss 134 that releasably engages the housing member 102 of the cutting knife housing 80 when the cutting knife 82 is in the closed position.

The illustrated cigar cutter 14 also includes a stop 140 and a spring 142 contacting the stop 140 for outwardly biasing the stop 140 to facilitate releasable engagement with the shell 24 to releasably lock the cigar cutter 14 in the cutting position. Manual pressing of the stop 140 compresses the spring 142 and enables the stop to disengage from notch 42 so that the cigar cutter 14 can be slid within the slot 16 desirably by pushing the base 120 of the cutting knife handle portion 84. The inner surface 144 of the shell 24 engages the stop 140 and maintains it in a depressed position as the stop 140 enters the slot 16 and as the cigar cutter 14 moves to its housed position. The illustrated stop 140 extends through an aperture 150 defined by the housing member 102 and includes a bottom lip 152 to engage a bottom surface 154 of the housing member 102 and to maintain the stop 140 within the aperture. The housing member 100 defines a void 160 on its top surface receiving the stop 140 and includes a hollow column 162 defining a chamber 164. The spring 142 is received within the chamber 64 and within a bore 180 defined by the bottom of the stop 140.

The notch 42 defined by the shell 24, the stop 140, the finger tab 122 and the notch 150 defined by the housing member 102 of the cutting knife housing 80 desirably have complementary configurations. As a result, the finger tab 122 can be received by the notch 42 of the shell 24 when the cigar cutter 14 is in the housed position, and can be received by the notch 150 of the cutting knife housing 80 when the cutting knife 82 is in the closed position. Additionally, the stop 140 is received by the notch 42 of the shell 24 to releasably engage the shell 24 when the cigar cutter 14 is in the open position. In the illustrated embodiment, for example, the notches 42 and 150 and the engaging portions of the finger tab 122 and stop 140 have complementary arcuate configurations.

The cigar cutter 14 in accordance with a preferred embodiment of the present invention operates as follows. Initially, the cigar cutter 14 is in a housed position within the lighter body 12 (see, e.g., FIG. 1). In this position: the cigar cutter 14 is received substantially within the slot 16; the cutting knife 82 is releasably locked in the closed position by the boss 132; the finger tab 122 is received by the notches 42 and 150 of the shell 24 and the housing member of the cigar cutter 14; and the stop 140 is depressed by the inner surface 144 of the shell 24.

The cigar cutter 14 can then be slid to the cutting position by grasping the finger tab 122 of the cutting knife handle portion 84 and pulling the cutting knife handle portion 84 relative to the cutting knife housing 80 and the lighter body 12. As the cutting knife handle portion 84 is pulled, the cutting knife 82 initially slides outside of the lighter body 12 to an open position and, once the side lips 112 of the cutting knife handle portion 84 contact the shoulders 114 of the housing members 100 and 102 of the cutting knife housing 80, the cutting knife housing 80 also slides outside of the lighter body 12. As the stop 140 emerges from the lighter body 12, it pops outwardly and is received by the notch 42 of the shell 24 causing engagement of the cigar cutter 14 and the lighter body 12, thereby releasably locking the cigar cutter 14 in the cutting position.

Thereafter, the cigar may then be inserted into the hole 92 of the cigar cutter 14, and then, by pushing the cutting knife handle portion 84 to the closed position, the cigar is cut by the cutting edge 96 of the cutting knife 82. The stop 140 prevents the cutting knife housing 80 from sliding into the lighter body 12 as the cutting occurs. To slide the cigar cutter 14 back into the lighter body 12, the stop 140 is manually pressed and the base 120 of the cutting knife handle portion 84 pushed until the finger tab 122 is received by the notch 42 of the shell 24.

The lighter mechanism 20 may have any suitable construction and may, in accordance with the illustrated embodiment, be a torch-type lighter that is well suited for igniting cigars. The illustrated lighter mechanism 20 comprises a lighter fuel container 200 received by a chamber 202 defined by the spacer member 28 for storing lighter fuel, an igniter 204 for creating a spark, a lever arm 206 engaged with the igniter and a valve 208 of the fuel container, and a torch mechanism 210 housed within the lighter head portion 34 for emitting fuel for ignition by the spark. The illustrated torch mechanism 210 emits fuel into a bore 220 defined by the lighter head portion 34 that extends generally perpendicular to the longitudinal axis of the lighter device 10. The valve 208 of the fuel container 200 is engaged with the torch mechanism 210 by a fuel conduit 222. Additionally, the igniter 204 includes a wire conduit 224 that extends from the igniter 204 to adjacent the torch mechanism 210 within the bore 220. The wire conduit 224 may be encased within a suitable protective covering and, if desired, may also be received by a further protective conduit 226.

The illustrated lighter mechanism 20 operates as follows. The switch member 36 is depressed, causing the lever arm 206 to open the valve 208 of the fuel container 200 and causing the fuel container to force fuel into the torch mechanism 210 and also causing the igniter 204 to create a spark within the bore 220 of the lighter head portion 34. The fuel emitted by the torch mechanism 210 is ignited by the spark causing the torch flame to be emitted out of the bore 220 in a direction generally perpendicular to the longitudinal axis of the lighter device 10.

The lighter device 10 in accordance with preferred embodiment of the present invention has a neat and compact appearance, and enables the cigar cutter 14 to be slid from a housed, and desirably substantially concealed, position to a cutting position in an effective manner. Because the cutting knife 82 is substantially concealed when not in use, it tends to have a longer life than the cutting knives of the prior art devices. Additionally, because the cutting knife 82 is substantially concealed when not in use, it is less likely to cause injury than the cutting knives of the prior art devices.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. A lighter device comprising (a) a lighter body adapted to create a flame and defining a slot;

(b) a cigar cutter slidably engaged with the lighter body and slidable between a housed position wherein the cigar cutter is received substantially within the slot and a cutting position wherein the cigar cutter is substantially outside of the lighter body, the cigar cutter including a cutting knife housing and a cutting knife slidably engaged with the cutting knife housing; and (c) a stop associated with the cigar cutter adapted to releasably lock the cutting knife housing to the lighter body when the cigar cutter is in the cutting position to prevent the cutting knife housing from sliding toward the housed position, and to unlock the cutting knife housing from the lighter body to permit the cutting knife housing to slide from the cutting position toward the housed position.

2. The lighter device of claim 1 further including a spring for biasing the stop.

3. The lighter device of claim 1 wherein the cutting knife housing defines a bore for receivably engaging the stop.

4. The lighter device of claim 3 further including a spring for biasing the stop.

5. The lighter of claim 1 further including a spring for outwardly biasing the stop and wherein the lighter body includes an inner surface defining the slot and adapted to inwardly bias the stop when the cutting knife housing is received within the slot.

6. The lighter device of claim 5 wherein the cutting knife housing defines a bore for receivably engaging the stop.

7. The lighter device of claim 1 wherein the lighter body defines a notch for receivably engaging the stop when the cigar cutter is in the cutting position.

8. The lighter device of claim 1 further including a handle portion associated with the cutting knife and having a finger tab.

9. The lighter device of claim 8 wherein the lighter body defines a notch for receivably engaging the finger tab when the cigar cutter is in the housed position.

10. The lighter device of claim 9 wherein the stop is receivably engaged by the notch of the lighter body when the cigar cutter is in the cutting position to releasably lock the cutting knife housing to the lighter body.

11. The lighter device of claim 10 wherein the cutting knife housing defines a notch for receivably engaging the finger tab when the cutting knife is in a closed position.

12. The lighter device of claim 1 wherein the cigar cutter is substantially concealed by the lighter body when the cigar cutter is in the housed position.

13. A lighter device comprising (a) a lighter body adapted to create a flame and defining a slot;

(b) a cigar cutter slidably engaged with the lighter body and slidable between a housed position wherein the cigar cutter is received substantially within the slot and substantially concealed by the lighter body and a cutting position wherein the cigar cutter is substantially outside of the housing, the cigar cutter including a cutting knife housing and a cutting knife slidably engaged with the cutting knife housing and slidable between open and closed positions, the cutting knife housing defining a passage slidably receiving the cutting knife and an aperture for receiving a cigar when the cutting knife is in the open position and the cigar cutter is in the cutting position;

(c) a stop associated with the cutting knife housing adapted to releasably lock the cutting knife housing to the lighter body when the cigar cutter is in the cutting position to prevent the cutting knife housing from sliding toward the housed position, and to unlock the cutting knife housing from the lighter body to permit the cutting knife housing to slide from the cutting mode position to the housed position; and (d) a spring for biasing the stop outwardly relative to the cutting knife housing.

14. The lighter of claim 13 wherein the lighter body includes an inner surface defining the slot and adapted to inwardly bias the stop when the stop is within the slot.

15. The lighter device of claim 13 wherein the cigar cutter includes a cutting knife handle portion associated with the cutting knife and having a finger tab.

16. The lighter device of claim 15 wherein the lighter body includes a shell that defines a notch for receivably engaging the finger tab when the cigar cutter is in the housed position, and for receivably engaging the stop to releasably lock the cutting knife housing to the lighter body when the cigar cutter is in the cutting position.

17. The lighter device of claim 16 wherein the cutting knife housing defines a notch for receivably engaging the finger tab when the cigar cutter is in the housed position.

18. The lighter device of claim 13 wherein the cigar cutter is substantially concealed by the lighter body when the cigar cutter is in the housed position.

19. The lighter device of claim 13 wherein the cutting knife housing defines a bore receivably engaging the stop.

20. The lighter device of claim 19 wherein the stop includes a lip for maintaining the stop within the bore.

21. The lighter device of claim 13 wherein the cigar cutter including a cutting knife handle portion mounted to the cutting knife, the cutting knife handle portion includes a boss for releasably engaging the cutting knife housing to releasably lock the cutting knife handle portion to the cutting knife housing when the cutting knife is in the closed position.

* * * * *